United States Patent [19]

Tangorra et al.

[11] Patent Number: 4,471,733

[45] Date of Patent: Sep. 18, 1984

[54] STARTER FOR INTERNAL COMBUSTION ENGINE

[75] Inventors: Giorgio Tangorra, Monza; Lino Magnabosco, Milan, both of Italy

[73] Assignee: Industrie Pirelli S.p.A., Milan, Italy

[21] Appl. No.: 343,823

[22] Filed: Jan. 29, 1982

[30] Foreign Application Priority Data

Jan. 29, 1981 [IT] Italy ..... 19392 A/81

[51] Int. Cl.[3] ..... F02N 5/02

[52] U.S. Cl. ..... 123/179.5; 123/185 S; 74/6; 185/39

[58] Field of Search ..... 123/179 S, 179 SE, 185 R, 123/185 P, 185 N, 185 S, 179 CC; 74/6; 185/37, 39

[56] References Cited

U.S. PATENT DOCUMENTS

| | | | |
|---|---|---|---|
| 1,248,352 | 11/1917 | Liberty | 185/37 |
| 1,514,832 | 11/1924 | Chilton | 123/185 N |
| 1,936,072 | 11/1933 | Roderick | 185/37 |
| 2,278,547 | 4/1942 | Herrington | 123/179 CC |
| 2,941,623 | 6/1960 | Tarrson | 185/37 |
| 3,216,529 | 11/1965 | Lohr | 185/39 |
| 3,602,337 | 8/1971 | Cain | 185/37 |
| 3,656,586 | 4/1972 | Robson | 185/37 |
| 4,315,562 | 2/1982 | Tangorra et al. | 185/37 |

*Primary Examiner*—Parshotam S. Lall
*Assistant Examiner*—W. R. Wolfe
*Attorney, Agent, or Firm*—Stevens, Davis, Miller & Mosher

[57] ABSTRACT

A mechanical starter for internal combustion engines in which the energy necessary to start the internal combustion engine is provided by elastomeric elements which are stretched by winding them around a nucleus composed of a plurality of mutually contacting washers is disclosed.

9 Claims, 6 Drawing Figures

STARTER FOR INTERNAL COMBUSTION ENGINE

This invention relates to a device for starting internal combustion engines and, in particular, to a mechanical starter for internal combustion engines.

Various kinds of devices for starting internal combustion engines are known. One known starting system has a motor operated by an electric power source (battery accumulator) which is temporarily connected to the internal combustion engine only for the necessary period to start the engine running. A second type of known starter is mechanical and has a spiral metallic spring, a first mechanical system for manually winding the spring and a second mechanical system to start the internal combustion engine by means of the spring energy.

The first type of known electric starter is operable only as long as the battery remains charged. After the battery has become discharged to under a certain level, for example, because of environmental causes such as too high or too low temperatures, the starter will not turn over the engine to start it.

The second type of known starter has the drawback of excessive weight and dimensions which must be increased with increase of the required torque and, moreover, has a characteristic torque-number of revolutions, for the return of the stored energy, which is linear because of the structure and of the material constituting the element which stores the energy, i.e. of the spiral spring.

Indeed for starting an internal combustion engine, and in particular for starting diesel cycle engines, it is necessary that the starter provide a very high maximum torque but, for example if the starter is installed on a vehicle, very strict weight and dimension constraints must be observed. Therefore, a starter supplied with a spiral spring set on a vehicle, if it is within weight and dimension specifications often will not supply sufficient torque to insure starting of the internal combustion engine of the vehicle.

An object of the invention is to provide a device for starting an internal combustion engine which is devoid of the foregoing disadvantages of the heretofore available electrical and mechanical starters. Another object of the invention is to provide an improved starter for internal combustion engines. Still another object of the invention is to provide a starter for internal combustion engines which is independent of any exhaustible energy source and has very high torque characteristic provided at the start-off with a suitable number of revolutions. A further object of the invention is to provide a starter for an internal combustion engine, which is relatively light in weight and of acceptable dimensions considering the torque it develops in comparison with prior art mechanical starters and is capable of providing a greater torque than the prior art devices of equal weight and dimensions.

Other objects of the invention will become apparent from the following description with reference to the accompanying drawing wherein.

The foregoing objects and others are accomplished in accordance with this invention, generally speaking, by providing a mechanical device for starting an internal combustion engine having a hand operated crank or the like operably connected through meshing gears for stretching elastomeric members confined between series of pins or stakes for storing energy, and means for transfering the stored energy to the shaft of the internal combustion engine to be started.

The invention contemplates broadly a mechanical starter for internal combustion engines, having a first means to transfer energy it receives to second means comprising deformable and, more particularly, stretchable energy storage means, to store the energy, and third means to transfer energy stored by the stretchable means to the internal combustion engine.

Figure 1:
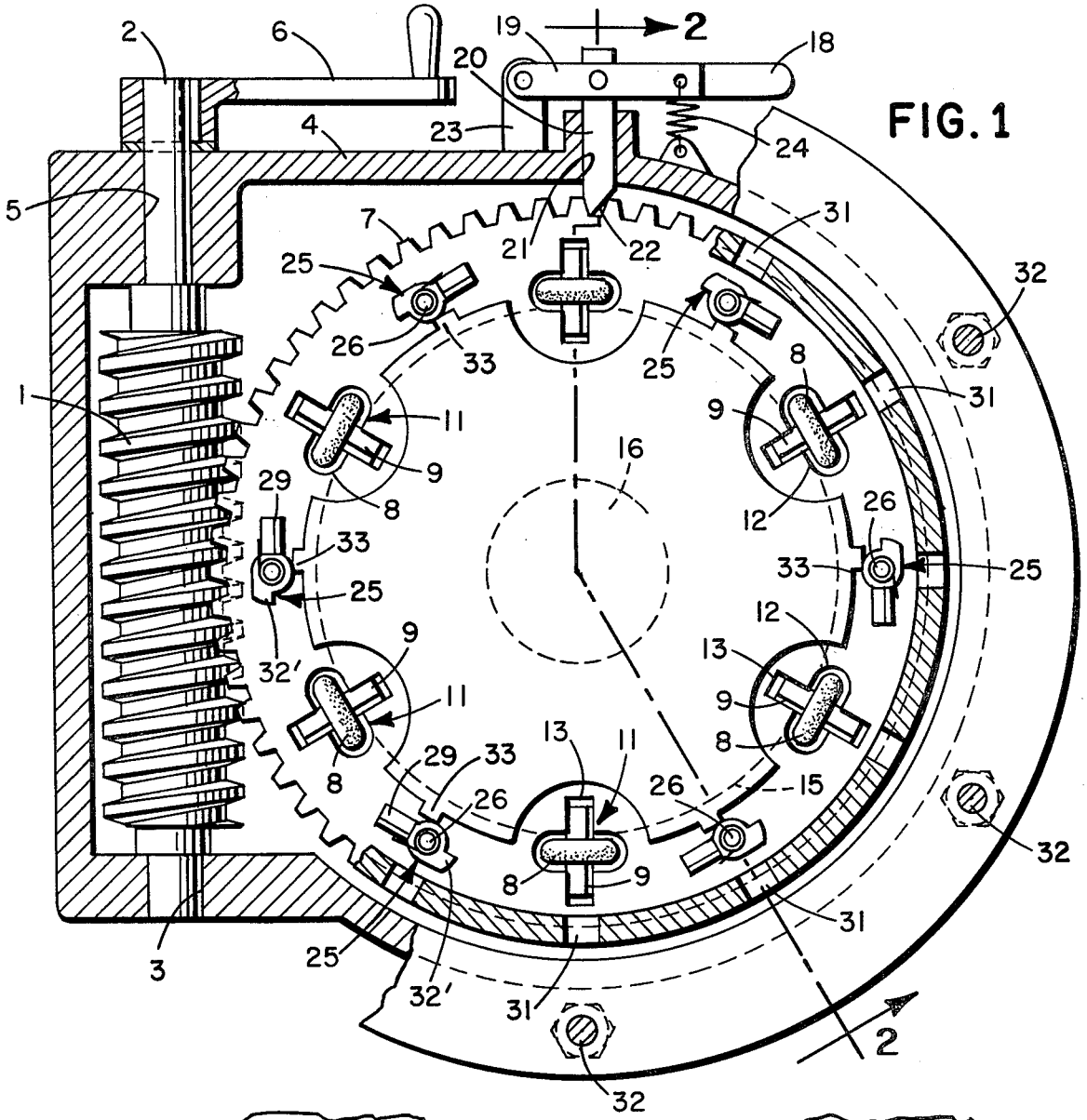
FIG. 1 is a section taken along line 1—1 of FIG. 2.
Figure 2:
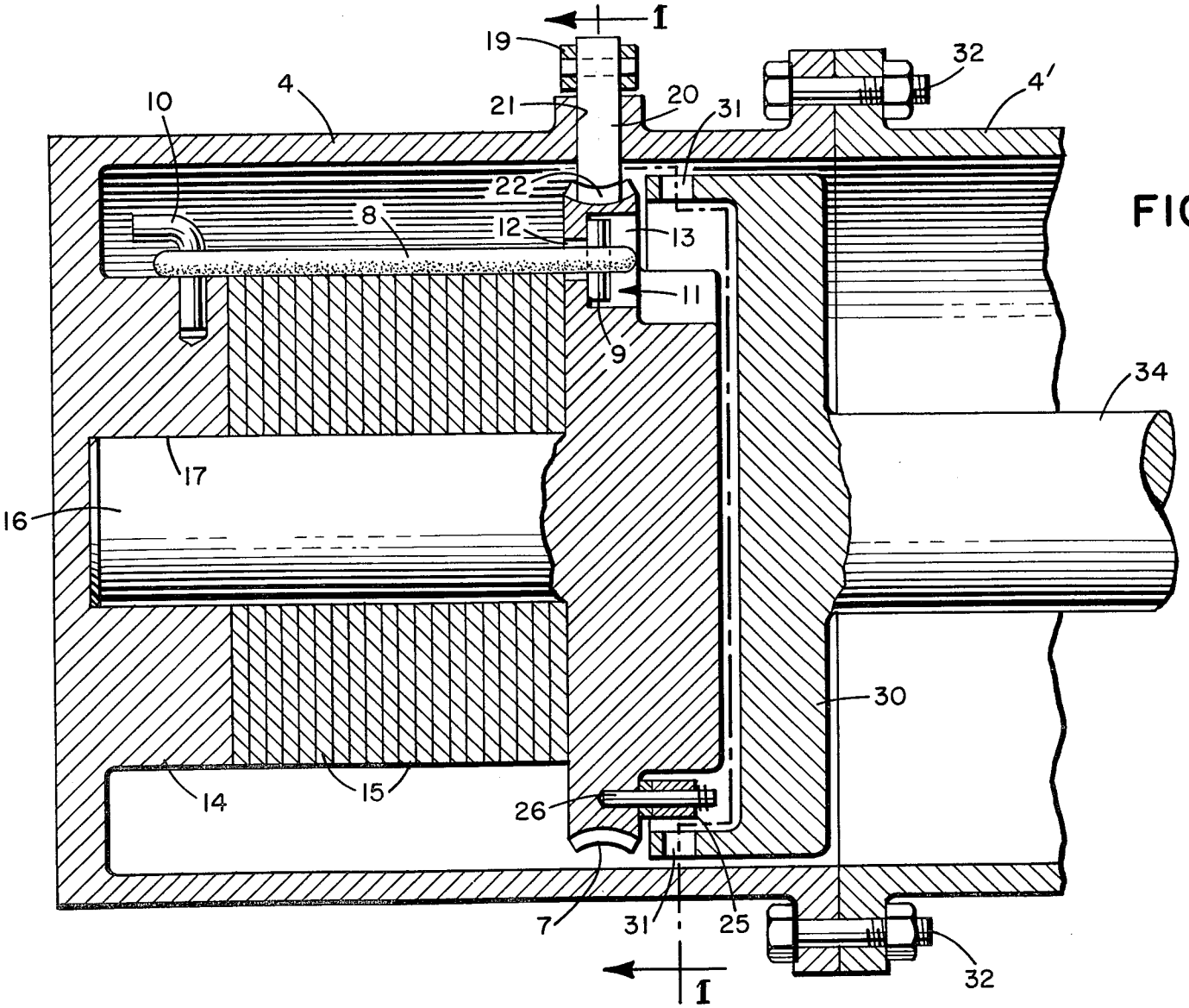
FIG. 2 is a longitudinal section of one embodiment of a device for starting internal combustion engines provided by the invention taken along the line 2—2 of FIG. 1.

As indicated above, FIG. 1 is a transverse sectional view of a mechanical starter for internal combustion engines according to the present invention taken along the line 1—1 of FIG. 2, while FIG. 2 is a longitudinal section taken along the line 2—2 of FIG. 1.

With reference to FIGS. 1 and 2, the illustrated mechanical starter has first means to transfer energy received from an outside source to second means in which the energy is stored.

The illustrated embodiment of the first means has a worm 1 fixed on a shaft 2 which is disposed at one end in a seat 3 fixed to starter housing 4 which is fixed to the engine block 4' (FIG. 2) by means of bolts 32.

The opposite end of shaft 2 extends beyond the housing 4 through a hole 5 in a wall of housing 4 and is provided with a crank handle 6 with which the worm screw can be set in motion.

Worm 1 meshes with a worm gear 7 to which are connected the stretchable means to store energy and which can be connected to the engine shaft (not shown) of an internal combustion engine through means later described in detail.

Figure 6:
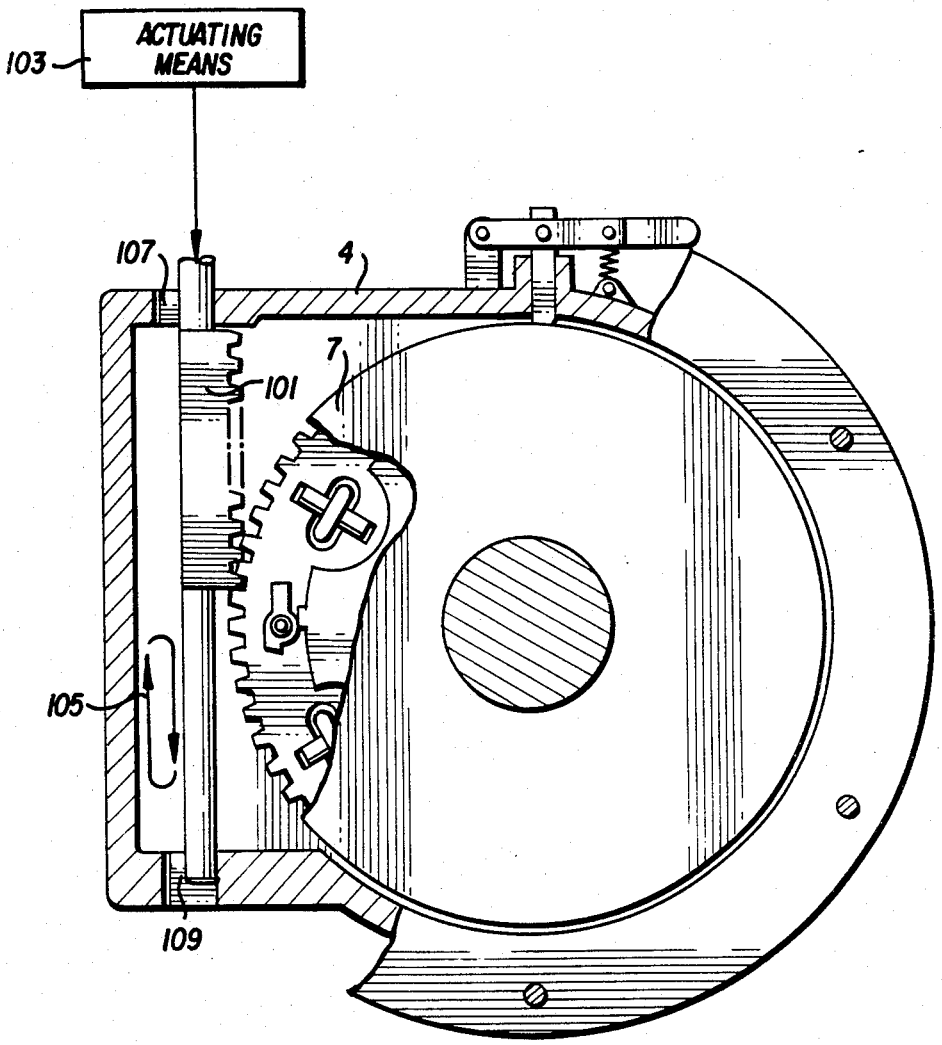
FIG. 6 is a view similar to FIG. 1, but showing a rack-and-gear arrangement instead of the worm-and-gear arrangement of FIG. 1.

An alternative embodiment of the first means to transfer the energy coming from the outside to the stretchable means to store energy comprises a rack, which can shift with alternative rectilinear motion, meshing with the gear, so the the worm gear can rotate during a phase of its motion, while during the back phase its teeth no longer mesh with the gear. FIG. 6 shows such a rack-and-gear arrangement where the rack 101 is arranged in such fashion that by means of a conventional actuating means 103 it can be brought into and out of engagement with the worm gear 7. The controlled motion of the rack 101 is shown by the "motion diagram" 105. The slots 107 and 109 in the wall of the housing 4 readily permit the desired engagement and disengagement of the rack 101 with the worm gear 7. Of course, in this embodiment the worm gear 7 might if desired be replaced by a conventional spur gear.

The rack can be set in motion by means of a system of levers by a proper pedal, set outside the envelope 4 of the mechanical starter provided by the invention, for example, in the operator's compartment of a vehicle upon which the starter is set or by means of a hydraulic operating system set in motion by a pedal set in the operator's compartment, which conveys the fluid under pressure by means of pipes and thereby activates the rack through an approproate device.

The mechanical starter of the invention, moreover, is provided with second means to store the energy provided to the starter having, as already stated, stretchable means which are preferably stretchable elastic elements, such as natural rubber or synthetic elastomer rings.

A particular embodiment of the stretchable means comprises a number of rings 8 of elastomeric material fixed between pairs of stakes or pins 9 and 10; the former belonging to a first series of stakes and the latter to a second series of stakes.

According to an alternative embodiment of the present invention the stretchable means for storing energy comprise elastomeric strips, helical springs or elastomeric sleeves having an end bound to the stakes 9 of the first series of stakes and an opposite end bound to the stakes 10 of said second series of stakes.

The rings 8 and the other embodiments of the stretchable means must be set between a stake 9 and a stake 10 under pretension, i.e. they are stretched to an extent that can vary between 10 and 60% of the length (i.e. half-circumference) that rings 8 have when they are not mounted in place. Consequently, the rings 8 are in a state of pretension also when the mechanical starter of the invention is not under load.

The stakes 9 of the first series of stakes are connected with the worm gear 7 and therefore they rotate together with gear 7 when it is set in motion by the first means adapted to transfer energy from the outside to the starter. The stakes 9 of the first series of stakes are pins, preferably metallic, having a smooth surface, set in appropriate slots 11 placed in the block having the worm gear 7 with a constant pitch along a circumference which is radially innermost with regard to the gear.

Slots 11 comprise an elongate opening 12 in gear 7 with notches 13 in which the ends of stakes 9 fit, spanning openings 12. Stakes 9 are retained by the tension exerted on them by the elastomeric rings 8, or by the other stretchable means used to store the energy. The stakes 10 of the second series of stakes are stationary with respect to the housing 4 of the mechanical starter of the invention and are radially placed on a cylindrical projection 14 formed on the inner wall of housing 4.

The elastomeric rings 8 or other stretchable means for storing energy, are supported between the stakes 9 and 10 on a surface of revolution parallel to the axis of rotation. The surface of revolution can be, for instance, conical or convex, but it is preferably a cylindrical surface obtained by means of a plurality of washers 15, provided with axial bores, set side by side contacting each other. Washers 15 can be of such material to reduce the friction of reciprocal contact such as, for example, antifricion metals or synthetic material such as aromatic polyamides.

Figure 5:
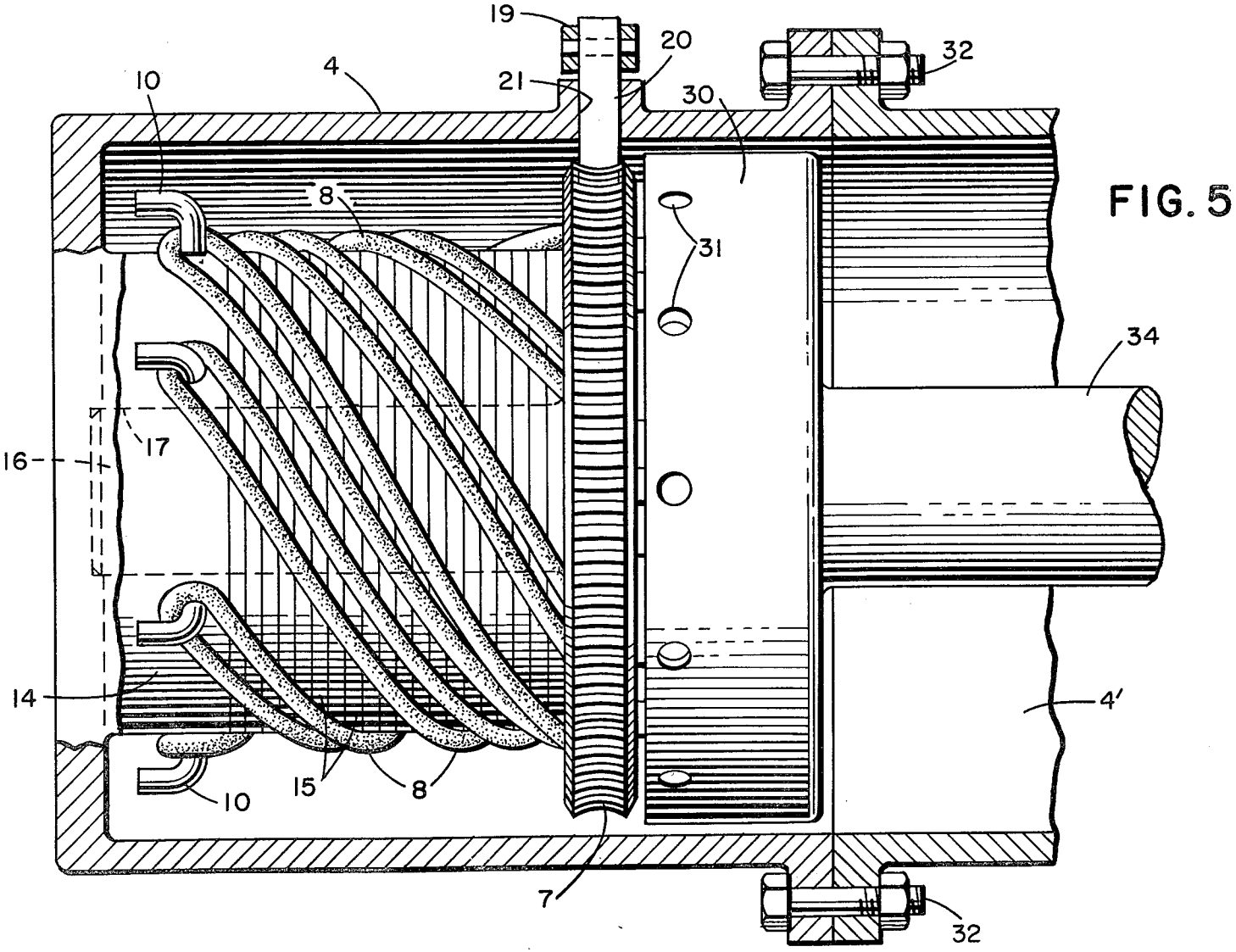
FIG. 5 is a view similar to FIG. 2 showing the starter partially wound up with the tension rings 8 wound around washers 15.

Each of washers 15 may be made of different materials in order to reach the above mentioned objective or they can be covered with appropriate materials such as, for example, polytetrafluorethylene. Washers 15 have a small thickness compared to their diameter and are in contact with each other. In the central coaxial bores of washers 15, a shaft 16 is inserted for supporting the plurality of washers. Shaft 16 can be attached to the gear 7 or it can be integral with the gear. Shaft 16 is rotataby journaled in a socket 17 formed in the projection 14 of the housing 4. Stakes 9 and 10, of the first and second series of stakes, are equally spaced around washers 15 and elastic rings 8 are in contact with the surface of washers 15. When gear 7 is rotated, elastic rings 8 are stretched and wound about washers 15 in a helical path as seen in FIG. 5, thus storing energy.

According to another alternative embodiment of a mechanical starter of the invention, (not shown in the drawing) the first means to transfer the energy received from the outside to the second means for storing energy comprise an extension of the shaft 16 outside the envelope 4 and a lever, a crank or the like, to set the shaft 16 in motion so that the first series of stakes can rotate with respect to the second series of stakes which is maintained fixed. In this embodiment, the gear 7 can be eliminated on condition that the shaft is provided with a safety device that prevents the accidental discharge of the energy stored in the elastomeric rings 8.

Also the embodiment of the invention, shown in FIGS. 1 and 2, is provided with a safety device which prevents the discharge of the energy stored in the elastic rings 8.

The device comprises a lever 18, set outside the housing 4 having a bifurcated end 19 where a pin 20 is hinged. Pin 20 extends through a hole 21 in the housing 4, and meshes with the teeth of the gear 7; preventing the rotation in the sense of discharging the energy stored in the rings 8, but allowing the rotation of the gear in the opposite direction, i.e. in the direction of stretching of rings 8, and consequently charging them.

This is obtained by means of a proper shaping of the end 22 of the pin 20 so as to allow, with the shape represented in the figure, anti-clockwise rotations of gear 7 but preventing clockwise rotation. Lever 18 is pivoted in support bracket 23 projecting from the housing 4 and is provided with a tension spring 24 which guarantees constant meshing of end 22 of pin 20 with the teeth of the gear 7.

The mechanical starter for internal combustion engines provided by the invention comprises, moreover, third means to transfer the energy stored from the second means to the internal combustion engine. The third means comprise a coupler attached to the rotatable member carrying stakes 9 and driven by the elastic rings 8. The couplers may be clutches, levers or the like.

Preferably the coupler is a centrifugally operated coupling i.e., a coupler which is brought into engagement with the engine shaft of the internal combustion engine by centrifugal force when the stretchable means for storing energy causes the rotation of the gear in which the first series of stakes is secured.

Figure 3:
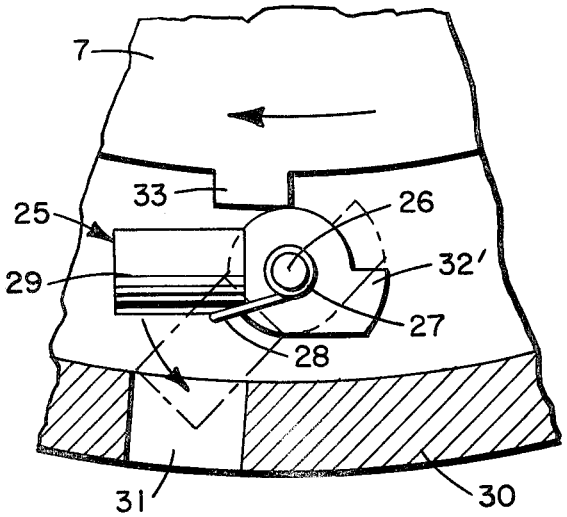
FIGS. 3 and 4 are enlarged plan views of a device for coupling the starter of the present invention to the shaft of an internal combustion engine in the rest position and in the working position, respectively.
Figure 4:
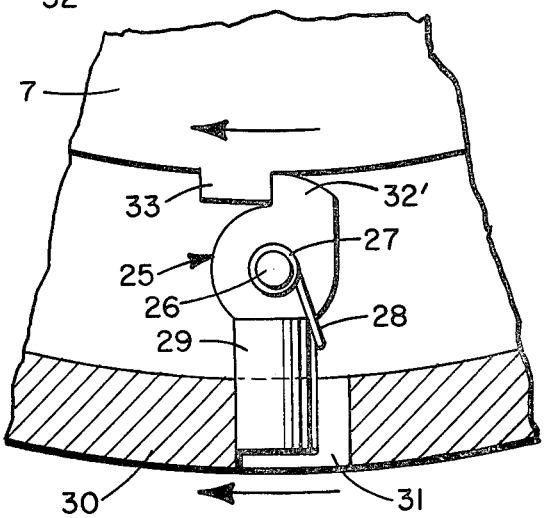

This kind of coupler is illustrated in the rest position in FIG. 3, and in the working position in FIG. 4. This coupler comprises therefore a number of pawls 25 pivoted on pins 26 on the surface of gear 7 facing the internal combustion engine.

Pawls 25 are equi-spaced along a circumference and staggered and alternated with respect to the slots 11 housing the stakes 9. Clip springs 27 are wound about the free end of pins 26 and end 28 of springs 27 is bent around pawl 25 urging it toward the rest position shown in FIG. 3.

Pawls 25 are provided with a substantially cylindrical portion 29 for engaging with holes 31 in sleeve 30 which is integral and preferably coaxial to the engine shaft 34 of the internal combustion engine. Pawls 25 are moreover, provided with a lug 32' for abutting against projections 33 on gear 7. When the centrifugal force exerted on pawls 25 overcomes the force of springs 27, the pawls 25 rotate to the position seen in FIG. 4 and cylindrical portions 29 enter the holes 31, lugs 32' engage projections 33 and the gear 7 and elastic rings 8 are drivingly connected to crank shaft 34.

An alternative embodiment of a centrifugal joint (not shown in the drawing) comprises cylinders placed in radial cavities in the block comprising the gear 7 provided with springs which keep them in position in the cavities.

The cylinders overcome the spring resistance when the block comprising the gear 7 is set in rotation, because of the centrifugal force applied on them and come out of the slots where they are housed and fit in holes in the sleeve, in a radially outermost position, very similar to the sleeve 30 previously described.

In another alternative embodiment (not shown in the drawing) of a mechanical starter for internal combustion engines provided by the present invention, the starter is provided with a device for charging automatically by means of the energy provided by the internal combustion engine.

The device for automatically charging the starter according to the present invention comprises a torque limiter friction clutch, to prevent overloading of the stretchable means for storing energy, and can directly mesh for example with the worm screw connected to the gear through a shaft which receives the motion from the shaft of the internal combustion engine.

The operation of a mechanical starter for internal combustion engines according to the present invention is as follows.

In order to start the cycle by charging the starter, crank 6 must first be rotated to rotate the worm 1. Worm 1 meshes with gear 7 and therefore rotates the gear 7 to which stakes 9 of the first series of stakes are secured. The gear winds the rings 8 (whose other ends are secured to the stakes 10 of the second series of stakes; which are stationary) about the surface of the washers 15 as seen in FIG. 5.

In this way, rings 8 are stretched, and, since they are in contact with the surface of washers 15, washers 15 are rotated; eliminating any relative sliding between washers and rings. When this occurs, the pin 20 of the safety device prevents the gear 7 from rotating in the opposite direction, which would allow the stored energy to be discharged. When the mechanical starter of the invention reaches the maximum charge, i.e. the rings 8 have been stretched as much as possible, operation of the handle 6 is stopped.

To indicate the moment when the stored energy reaches the desired amount, a proper conventional gauge may be employed. At this moment the lever 18 can be activated releasing the pin 20 from the gear 7. Gear 7 will begin to rotate by means of the energy stored in the rings 8 during their elongation. The centrifugal force acting on the pawls 25 will make them overcome the resistance of springs 27 and place them in a radial position (as seen in FIG. 4) so that the cylindrical portion 29 of pawls 25 extends into holes 31 in sleeve 30.

Sleeve 30, being connected with the engine shaft 34 of the internal combustion engine, makes the latter rotate causing the induction, the compression and the ignition of fuel mixture in the cylinders of the internal combustion engine, i.e. the starting of the internal combustion engine.

As to the assembly phases, in particular the assembly of the stretchable means for storing energy; first, the rings 8 must be connected to the stakes 10, the shaft 16 is inserted through the holes of washers 15 into socket 17; second, the rings 8 must be stretched so that the free end can come out of the slots 11 and the stakes 9 inserted in the rings. Then the stakes 9 will be placed in the notches 13 of the slots where they will be retained by the tension exerted on them by the rings 8. If desired, the rings 8 may be mechanically secured to stakes 10 and the stakes 9 fixed in the notches 13.

A mechanical starter for internal combustion engines according to the present invention accomplishes the predetermined objects. The mechanical starter can be charged with energy provided manually or energy provided automatically by the internal combustion engine, for example, before the engine stops. Moreover, the different kinds of stretchable means disclosed as suitable to store energy provide, unlike the known mechanical starters, a characteristic torque-number of revoluions which increases abruptly as the number of revolutions increases. This characteristic provides therefore a greater guarantee and a greater capacity of the starters to start promptly any internal combustion engine also for instance of a diesel cycle type. In fact with regard to the known mechanical starters, the starter according to the present invention can provide, if the weights and dimensions are the same, a much higher torque or, the supplied torque being the same, the dimensions and weight can be reduced. This can be a great advantage for the starters installed on vehicles or watercraft where dimensions and/or weight may be a problem.

The particular structure of the mechanical starter provided by the invention provides, moreover, the required working reliability. In fact, the close contact between adjacent washers 15, in particular in correspondence of the cylindrical surface of revolution on which the rings 8 rest, prevents rings 8 from being pinched between adjacent washers also for very high loading angles. Moreover, the continuous contact between washers 15 and rings 8 allows the rings to pull, in the winding motion around the surface of revolution defined by the washers; washers 15 thus eliminating any relative sliding between rings 8 and washers 15.

In this way rings 8 are only subjected to tensile stress, which can be better supported by the elastomeric material constituting them. All this is even more pointed out by the fact that the thickness of the ring is very small with respect to its diameter.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. A device for starting an internal combustion engine having a crank shaft, cylinders and pistons slidably disposed in the cylinders, said device comprising stretchable rings stretched between spaced stakes of two series thereof, a block comprising a gear, a worm gear meshing with the gear, handle means fixed to the said shaft for rotating the worm gear and gear, said stakes comprising pins about which said rings are disposed in slots circumferentially spaced in the gear and a plurality of contacting side-by-side washers mounted on a rotatable shaft connected to the gear and contacting said rings, and means operably connecting said stretchable rings to said crank shaft to move said pistons in said cylinders to compress and ignite a fuel mixture in the cylinders and commence reciprocating movement of the pistons in their cylinders.

2. The device of claim 1, wherein said means for stretching said elastomeric rings comprises a gear, a worm gear meshing with teeth of the gear and having a shaft, a crank fixed to the shaft for rotating the worm gear and gear, a series of side-by-side contacting washers disposed about a shaft, a first series of stakes mounted on the gear for rotation with the gear, a second series of stakes spaced from the first series of stakes and fixed against rotation with the gear, a series of stretchable elastomeric rings fixed at one end to a stake of the first series and fixed at an opposite end to a stake of the second series, whereby upon rotation of the gear the rings are stretched and rotate said washers and tensile stress is developed in the rings.

3. A mechanical starter for starting an internal combustion engine comprising a housing, first means for developing energy, second means for storing said energy, and third means to transfer the stored energy from said storage means to an internal combustion engine, characterized in that said energy storage means comprises stretchable members mounted between stakes of a first series, and stakes of a second spaced-apart series, the stakes of the first series being rotatable with respect to the states of the second series that are fixed to the housing, a plurality of coaxially bored washers contacting each other and defining a surface of revolution supporting said stretchable members that in turn are wound by means of a relative rotation of said first series of stakes with respect to said second series of stakes, and a shaft extending through the coaxial bores of said washers.

4. The starter of claim 3, wherein said stretchable members are elastomeric strips having each end bound to corresponding stakes of said first and second series of stakes.

5. The starter of claim 3, wherein said stretchable members are elastomeric rings fixed to corresponding stakes of said first and second series of stakes.

6. The starter of claim 4 or 5, wherein said first means comprise a rack, means for activating said rack, and a gear activated by means of said rack, said gear mounting the stakes of the said first series.

7. The starter of claim 6, wherein said third means for transfering energy from the storage means to the internal combustion engine comprise a centrifugal joint connected to said first series of stakes, adapted to be connected to the engine shaft of the internal combustion engine.

8. The starter of claim 4 or 5, wherein said first means comprises a worm screw, crank means for activating said worm screw, and a gear activated by said worm screw, said gear mounting the stakes of the said first series.

9. The starter of claim 8, wherein said third means for transfering energy from the storage means to the internal combustion engine comprise a centrifugal joint connected to said first series of stakes, adapted to be connected to the engine shaft of the internal combustion engine.

* * * * *